US008403126B1

(12) United States Patent
Shore

(10) Patent No.: US 8,403,126 B1
(45) Date of Patent: Mar. 26, 2013

(54) METHOD OF OPERATING ROLLING MILL CONVEYOR

(75) Inventor: T. Michael Shore, Princeton, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 13/559,311

(22) Filed: Jul. 26, 2012

Related U.S. Application Data

(60) Provisional application No. 61/539,200, filed on Sep. 26, 2011.

(51) Int. Cl.
*B65G 47/26* (2006.01)

(52) U.S. Cl. ..... 198/419.2; 198/418.8

(58) Field of Classification Search ..... 198/461.1, 198/461.2, 419.2, 418.8
See application file for complete search history.

(56) References Cited

U.S. PATENT DOCUMENTS 4,607,744 A * 8/1986 Pak ..... 198/461.2
4,629,058 A * 12/1986 Reissmann et al. ..... 198/461.1
5,158,278 A * 10/1992 Auf der Mauer ..... 198/419.2
6,945,531 B2 * 9/2005 Perobelli et al. ..... 271/270

FOREIGN PATENT DOCUMENTS

DE 4117906 A1 12/1992
EP 0132588 A1 2/1985

OTHER PUBLICATIONS

PCT International Search Report mailed Jan. 25, 2013 corresponding to PCT International Application No. PCT/US2012/055708 filed Sep. 17, 2012 (11 pages).

* cited by examiner

*Primary Examiner* — James R Bidwell

(57) ABSTRACT

In a rolling mill in which hot rolled product is formed into rings by a laying head and the rings are transported in an overlapping pattern to a reforming station where the rings are gathered into coils, a method of increasing the time gap between billet lengths of product delivered to the reforming station by advancing the rings of a front end of one billet along said conveyor at a one speed while advancing the rings of a tail end of a preceding billet at another speed greater than said one speed.

6 Claims, 2 Drawing Sheets

| | A | B | | | | C | | | |
|---|---|---|---|---|---|---|---|---|---|
| | | $B_1$ | $B_2$ | $B_3$ | $B_4$ | $C_1$ | $C_2$ | $C_3$ | $C_4$ |
| PHASE I | 0.7 | 0.5 | 0.5 | 0.5 | 0.5 | 0.5 | 0.5 | 0.5 | 0.5 |
| PHASE II | 0.7 | 0.8 | 0.8 | 0.8 | 0.8 | 0.8 | 0.8 | 0.8 | 0.8 |
| PHASE III | 0.7 | 0.5 | 0.8 | 0.8 | 0.8 | 0.8 | 0.8 | 0.8 | 0.8 |
| PHASE IV | 0.7 | 0.5 | 0.5 | 0.5 | 0.8 | 0.8 | 0.8 | 0.8 | 0.8 |

FIG. 3

METHOD OF OPERATING ROLLING MILL CONVEYOR

CROSS REFERENCE TO RELATED APPLICATION

This application claims benefit, under 35 U.S.C. §119(e), of U.S. Provisional Application Ser. No. 61/539,200, filed 26 Sep. 2011, the entire contents and substance of which is hereby incorporated by reference.

BACKGROUND

1. Field

Embodiments of the present invention relate generally to rolling mills in which successive billet lengths of a hot rolled product are formed into rings by a laying head, and are concerned more particularly with a method of operating a conveyor employed to transport the rings from the laying head to a remote reforming station where the rings are gathered into coils.

2. Description of Related Art

In a conventional rolling mill, as depicted schematically in FIG. 1, a preheated billet is hot rolled into a rod in a succession of roll stands, the last of which is depicted at 8. The hot rolled product is formed into rings "R" by a laying head 10, and the rings are deposited on a conveyor 12 for transport in an overlapping pattern to a remote reforming station 14 where the rings are gathered into coils. A typical modern day rolling mill can produce rod at a rate per strand of up to 160 tons/hour, with the rod being gathered at the reforming station into coils weighing 1.8 tons or more.

The time gap between billets is typically about 5 seconds, and the time to roll a coil of 1.8 tons at 160 tons/hr is approximately:

$$160/1.8 = 88.9 \text{ and } \frac{3600}{88} = 40.5 \text{ sec.}$$

Normally, it takes about 15 seconds to clear a completed coil from the reforming station, during which time some of the rings of the next billet length must be temporarily accumulated above the reforming chamber. Thus, taking into account the 5 second gap between billets, approximately 25% (15-5/40.5) of the coil must be suspended and then dropped into the reforming chamber at the beginning of the next coil forming cycle.

Experience has shown that dropping this amount of product into the reforming chamber at the beginning of each coil forming cycle can distort the coil base, resulting in an unstable coil. Moreover, maintaining a 5 second gap between billets can result in a loss of up to 10% of mill utilization time.

SUMMARY

Broadly stated, embodiments of the present invention are directed to a method of operating a rolling mill conveyor so as to reduce the amount of product being temporarily accumulated above a reforming chamber between coil forming cycles, while also making it possible to reduce the time gap between billets being processed by the mill.

In exemplary embodiments, this can be achieved by subdividing the conveyor into a first section positioned and arranged to receive the rings from the laying head in an overlapping pattern, and one or more succeeding conveyor sections leading from the first section to the reforming station. The succeeding conveyor sections are preferably further subdivided into shorter individually driven modules. The rings are advanced along the first conveyor section at a first speed selected to achieve a ring offset dictated by thermal process considerations, e.g. a higher speed to spread the rings in order to achieve enhanced cooling, or a slower speed to more densely pack the rings when retarded cooling is required. While rings are being transported by both the first and succeeding conveyor sections, the rings are advanced along the modules of the succeeding conveyor sections at a second speed which may or may not be different from the first speed, and which is selected to achieve an ordered delivery of rings to the reforming chamber. Once the tail end of a billet length of product has cleared the first conveyor section, the rings are advanced along the modules of the succeeding conveyor sections at a third speed higher than the second speed. As the modules of the succeeding conveyor sections are cleared by the last rings of one billet length of product, they are progressively slowed to convey the rings of the next succeeding billet length of product at the lower second speed. The speed differential between the first and second speeds progressively increases the time gap between successive billet lengths of product being transported on the conveyor.

These and other objects, features, and advantages of the present invention will become more apparent upon reading the following specification in conjunction with the accompanying drawings.

BRIEF DESCRIPTION OF THE DRAWINGS

FIG. 3 is a table outlining an illustrative mode of conveyor operation in accordance with aspects of the present invention.

DETAILED DESCRIPTION

Figure 1:
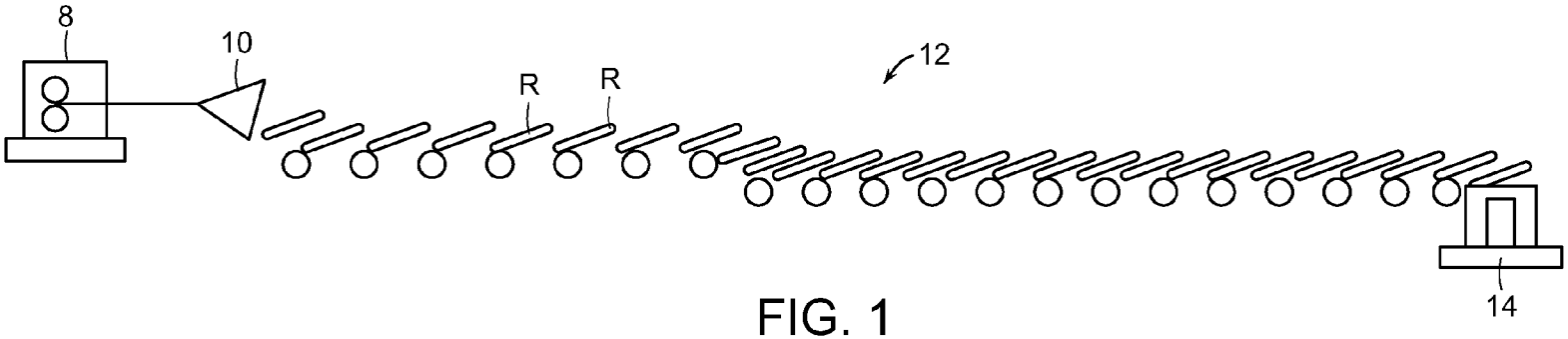
FIG. 1 (Prior Art)
FIG. 1 is a schematic illustration of a conventional conveyor system for transporting hot rolled product in overlapping, rings from a laying head to a remote coil forming station.
Figure 2:
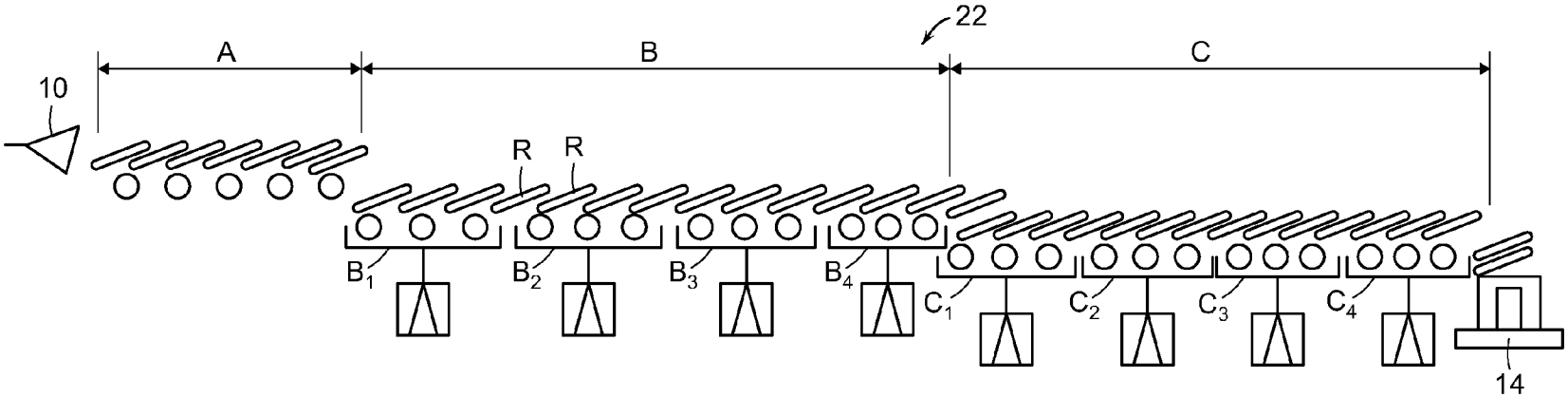
FIG. 2 is a schematic illustration of a conveyor configured to operate in accordance with aspects of the present invention.

In accordance with aspects of the present invention, as depicted schematically in FIG. 2, a conveyor 22 is positioned between the laying head 10 and the reforming station 14. The conveyor 22 is subdivided into a first section A arranged to receive the rings in an overlapping pattern from the laying head, and at least one further section which as shown in the illustrated embodiment can be two succeeding sections B and C leading from the first section A to the reforming station. The conveyor sections B and C may each be further subdivided respectively, for example as illustrated in FIG. 2, into shorter separately driven modules $B_{1-4}$ and $C_{1-4}$.

In accordance with an exemplary embodiment of the present invention, the conveyor sections B and C can each measure approximately 18 meters in length, with each individual module measuring approximately 4.5 meters in length. An illustrative example of how the method of the present invention is practiced is described with reference to the Table of FIG. 3 as follows:

Phase I

A billet length of product is transported on sections A, B and C of the conveyor. The rings are advanced along section A at a speed of about 0.7 m/sec, and along sections B and C at a speed of about 0.5 m/sec.

Phase II

The tail end of the product has just cleared section A of the conveyor. The modules $B_{1-4}$ and $C_{1-4}$ are speeded up to convey the rings at an increased speed of about 0.8 m/sec. The front end of the next billet length of product is received on and transported along section A at about 0.7 m/sec.

Phase III

The front end of the next billet length of product has cleared section A of the conveyor and has been received on the first module $B_1$ of section B. The first module $B_1$ has been adjusted to slow the advance of the first rings back down to about 0.5 m/sec., while the remaining rings of the previous billet length continue along modules $B_{2-4}$ and $C_1$-$C_4$ at the higher speed of about 0.8 m/sec. Thus, the time gap between billet lengths on the conveyor begins to increase.

Phase IV

The tail end section of the first mentioned billet continues along modules $B_4$ and $C_1$-$C_4$ at the higher speed of about 0.8 m/sec., while the front end section of the succeeding billet continues along modules $B_{1-3}$ at the slower speed of approximately 0.5 m/sec., resulting in a growing time gap between the two billet lengths.

In this exemplary embodiment, the time for the tail end of a product length to transverse sections B and C may be calculated as $$\frac{2\times 18\text{ m}}{0.8\text{ m/sec}} = 45\text{ sec.}$$

Also, in this example, the time for a front end to transverse sections B and C may be calculated as $$\frac{2\times 18\text{ m}}{0.5\text{ m/sec}} = 72\text{ sec.}$$

According, in this example, by operating the conveyor in the above described manner, a time gap of approximately 27 sec. can be created on the conveyor between the delivery of successive billet lengths of product to the reforming station.

The mill operator can use this time gap either to beneficially reduce or eliminate the need to temporarily accumulate product above the reforming chamber when clearing a completed coil, and/or to reduce the gap time between the introduction of billets into the mill, thus beneficially increasing mill utilization. In situations where the conveyor sections are being operated in a retarded cooling mode, or where the time gap between successive billets is being kept to a minimum, e.g., 2 sec., it may be advisable to briefly accelerate the speed at which the tail end rings of one billet are being conveyed so as to avoid those rings from being overlapped by the front end rings of the next billet.

While exemplary embodiments of the invention have been disclosed many modifications, additions, and deletions can be made therein without departing from the spirit and scope of the invention and its equivalents, as set forth in the following claims. For example, the number and length of the conveyor sections and individually driven conveyor modules, as well as the different speeds at which rings are transported thereon, can be varied to accommodate different thermal processes as well as different product types and metallurgies.

What is claimed is:

1. In a rolling mill in which successive billet lengths of hot rolled product are formed into rings by a laying head, and the rings are transported in an overlapping pattern along a conveyor from the laying head to a reforming station where the rings are gathered into coils, a method of operating the conveyor to increase the time gap between successive billet lengths being transported along the conveyor, said method comprising:

subdividing said conveyor into a first section arranged to receive the rings from said laying head, and at least one additional section leading from said first section to said reforming station, said additional section being further subdivided into separately driven modules; and while the rings of a tail end of one billet length and the rings of a front end of a successive billet length are both being transported along said additional section, advancing the rings of said tail end along some of said modules at a speed greater than the speed at which the rings of said front end are being advanced along other of said modules.

2. The method of claim 1 wherein while one billet length of product is being transported along both said first conveyor section and said additional conveyor section, the rings on said first conveyor section are advanced at a first speed selected to achieve a ring offset dictated by thermal process considerations, and the rings on said second conveyor section are advanced at a second speed which may or may not differ from said first speed.

3. The method of claim 2 wherein said second speed is lower than said first speed.

4. The method of claim 3 wherein after clearing said first conveyor section, the rings of said tail end are advanced along the modules of said additional conveyor section at a third speed greater than said first and second speeds.

5. The method of claim 4 wherein while the rings of said front end are being transported solely along said first conveyor section at said first speed, the rings of said tail end continue to be advanced along the modules of said additional conveyor section at said third speed.

6. In a rolling mill in which successive billet lengths of hot rolled product are formed into rings by a laying head, and the rings are transported in an overlapping pattern along a conveyor from the laying head to a reforming station where the rings are gathered into coils, a method of operating the conveyor to increase the time gap between successive billet lengths being transported along the conveyor, said method comprising:

subdividing said conveyor into a first section arranged to receive the rings from said laying head, and at least one additional section leading from said first section to said reforming station, said additional section being further subdivided into separately driven modules;

wherein while one billet length of product is being transported along both said first conveyor section and said additional conveyor section, advancing the rings on said first conveyor section at a first speed, and advancing the rings along the modules of said second conveyor section at a second speed slower than said first speed;

wherein after the rings of a tail end of the said one billet length have cleared said first conveyor section, advancing the rings of said tail end along the modules of said additional conveyor section at a third speed greater than said first and second speeds; and wherein after the rings of a front end of a next successive billet length are delivered from said first conveyor section to said additional conveyer section, advancing the rings of said front end along some of the modules of said additional section at said second speed while continuing to advance the rings of said tail end on other modules of said additional section at said third speed.

* * * * *